US006955318B2

(12) United States Patent
Nonomura

(10) Patent No.: US 6,955,318 B2
(45) Date of Patent: Oct. 18, 2005

(54) TAPE CASSETTE AND TAPE UNIT

(75) Inventor: Yoshihito Nonomura, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/399,535

(22) PCT Filed: Sep. 27, 2001

(86) PCT No.: PCT/JP01/08410

§ 371 (c)(1),
(2), (4) Date: Apr. 18, 2003

(87) PCT Pub. No.: WO02/32680

PCT Pub. Date: Apr. 25, 2002

(65) Prior Publication Data

US 2004/0056143 A1 Mar. 25, 2004

(30) Foreign Application Priority Data

Oct. 19, 2000 (JP) ..... 2000-319077

(51) Int. Cl.[7] ..... B41J 11/26
(52) U.S. Cl. ..... 242/344; 400/613; 400/615.2
(58) Field of Search ..... 242/344, 348, 242/357, 912; 400/208, 242, 613, 615.2

(56) References Cited

U.S. PATENT DOCUMENTS 5,277,503 A * 1/1994 Nagao ..... 400/208
6,042,280 A 3/2000 Yamaguchi et al.
6,247,860 B1 6/2001 Yanagisawa

FOREIGN PATENT DOCUMENTS

| | | |
|---|---|---|
| EP | 0 872 352 A1 | 10/1998 |
| EP | 1 041 024 A2 | 10/2000 |
| JP | A-07-025123 | 1/1995 |
| JP | A-7-69497 | 3/1995 |
| JP | A-7-89196 | 4/1995 |

* cited by examiner

*Primary Examiner*—John Q. Nguyen
(74) *Attorney, Agent, or Firm*—Oliff & Berridge, PLC

(57) ABSTRACT

In a tape cassette (5) to be used for a tape printing device (1), a roll part T0 of a print tape T having a preset tape width is firmly attached to the under surface of a rotation support section (21*a*) of a tape unit (20) by a lower spool (22). The tape unit (20) is provided with a tape identification section (30) for identifying the type etc. of the rolled tape. In the tape identification section (30), a vertical through hole (61) as a tape width identification part is provided varying its position depending on the tape width. Meanwhile, a cassette case body (32) and a cassette cover (33) of the tape cassette (5) are provided with a tape detection part (50*a*, 50*b*) to which the tape identification section (30) can be set or attached, while being provided with a projection (52) as a tape width detection part to be paired with the vertical through hole (61) so that only a tape unit (20) including a rolled print tape having a preset tape width is allowed to be attached to the tape cassette (5). By the composition, erroneous loading of an improper tape unit (20) (to which a tape of a different width has been set) in the tape cassette (5) can be prevented.

20 Claims, 7 Drawing Sheets

TAPE CASSETTE AND TAPE UNIT

TECHNICAL FIELD

The present invention relates to the composition of a tape cassette which is used for a tape printing device for creating lettered tapes (tapes having characters such as letters printed thereon), in which a tape unit including a rolled print tape is exchangeably loaded in a cassette case body, and in particular, to the composition of the tape unit and the tape cassette by which the tape cassette (corresponding to a preset tape width) is prevented from being loaded with an improper tape unit to which a print tape of a different tape width has been set.

BACKGROUND OF THE INVENTION

In consideration of the purpose of use of lettered tapes created by use of the tape printing device, it becomes necessary to employ multiple types of print tapes having different tape widths. Meanwhile, from the viewpoint of resource saving, it is desirable that the cassette case can be reused when the print tape in the cassette case is used up. A tape cassette proposed by the present inventors in Japanese Patent Provisional Publication No. HEI07-25123 in consideration of the above requests was designed to have the following composition and strong points: When the print tape in the cassette case is used up, an empty tape unit (whose print tape has run out) stored in a tape cassette (including a cassette case body and a cassette cover detachably covering the open top of the cassette case body) can be replaced with a new tape unit to which a brand-new print tape has been set. Multiple types of tape units corresponding to multiple types of print tapes of different tape widths can be stored in a tape cassette of a single type. For this, each tape unit is provided with a tape width discrimination member.

DISCLOSURE OF THE INVENTION

However, the above tape cassette involves the following problems or drawbacks. If the user tried to store an improper tape unit L (to which a print tape of a large tape width has been set) in a tape cassette that is capable of storing a tape unit S (to which a print tape of a small tape width has been set), the user notices his/her error since the cassette cover can not be closed. On the other hand, a tape cassette capable of storing the tape unit L (to which a print tape of the large tape width has been set) naturally has a tape unit storage section (between the cassette case body and the cassette cover) whose depth is greater. Therefore, if the user erroneously stored the tape unit S (to which a print tape of the small tape width has been set) in the tape cassette designed for the large tape width without noticing the error, the tape unit moves and rattles in the tape unit storage section, by which skewing occurs to the print tape being pulled out from the tape unit. By the skewing of the tape, the posture of characters (letters etc.) printed on the tape might be distorted, and in the worst case, the pulling out and feeding of the print tape becomes impossible.

The present invention, which has been made in order to resolve the above problems, aims to provide a tape cassette exchangeably storing a tape unit by which the width and type of the print tape can be identified when the tape unit is replaced, and by which erroneous loading of an improper tape unit (to which a print tape of a different tape width has been set) in the tape cassette (e.g. erroneous storing of a tape unit S (for the narrower print tape) in a tape cassette that is capable of storing a tape unit L (for the wider print tape)) can be prevented.

In accordance with an aspect of the present invention, in a tape cassette to be used for a tape printing device, comprising: a cassette case body; its cassette cover; and a tape unit including a rolled print tape which is detachably stored between the cassette case body and the cassette cover, the tape unit is provided with a tape identification section for identifying the type etc. of the rolled tape. In the tape identification section, a tape width identification part is provided varying its position or shape depending on the width of the tape. Meanwhile, the cassette case body and/or the cassette cover is provided with a tape detection part to which the tape identification section can be set or attached, while being provided with a tape width detection part to be paired with the tape width identification part so that only a tape unit including a rolled print tape having a preset tape width is allowed to be attached to the tape cassette.

BRIEF DESCRIPTION OF THE DRAWINGS

The objects and features of the present invention will become more apparent from the consideration of the following detailed description taken in conjunction with the accompanying drawings, in which.

BEST MODE FOR CARRYING OUT THE INVENTION

Figure 1:
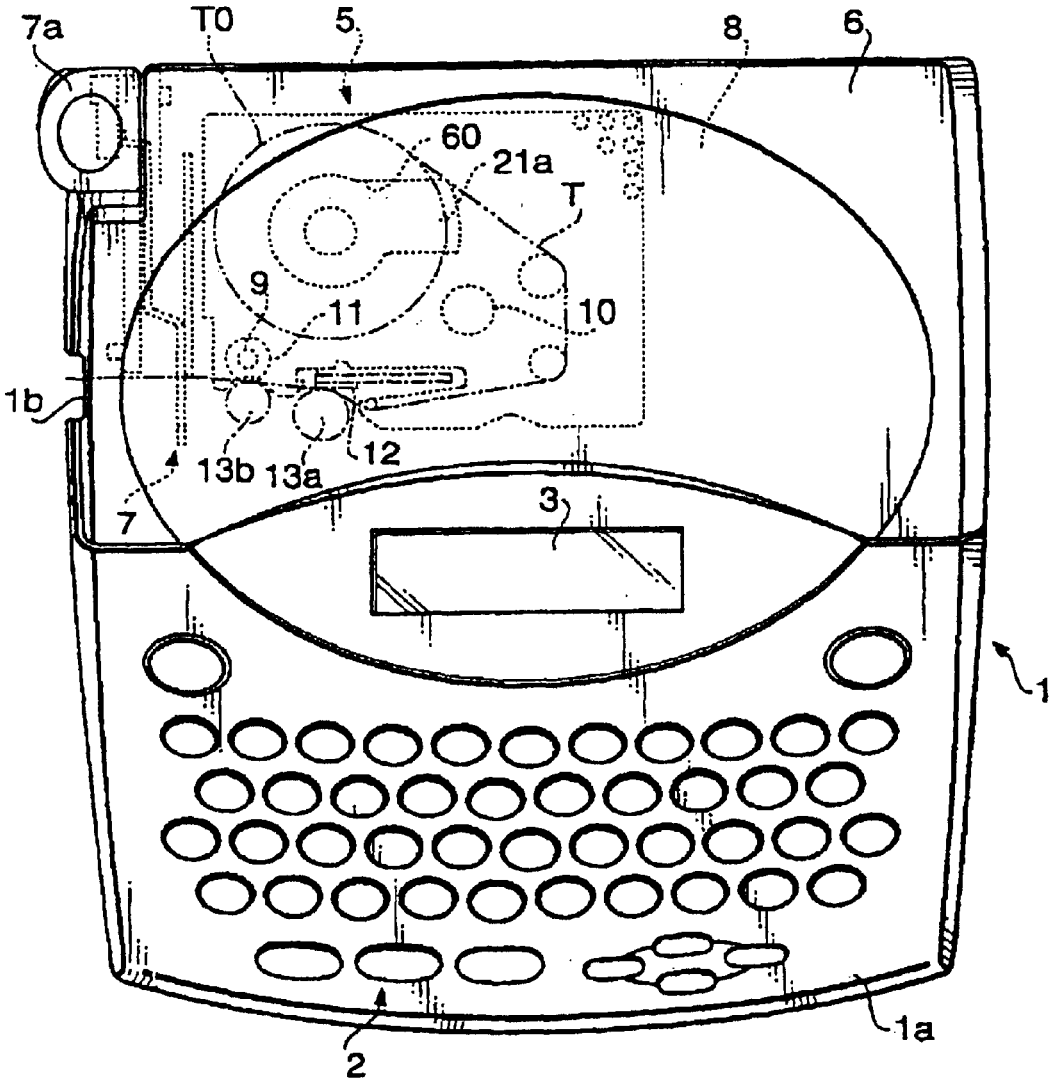
FIG. 1 is a plan view showing a tape printing device with the cover of its tape cassette storage section closed.
Figure 2:
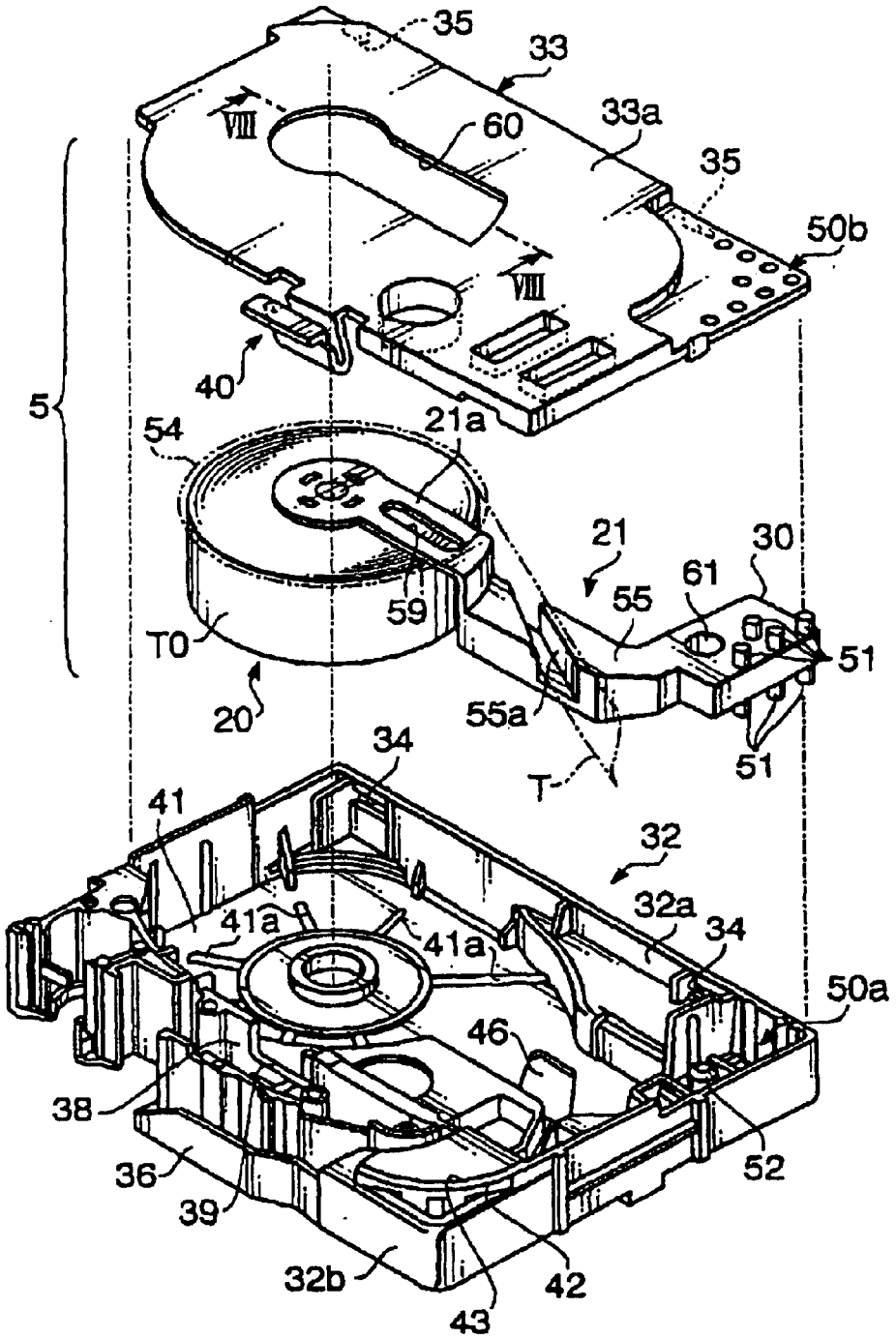
FIG. 2 is an exploded perspective view of a tape cassette in accordance with an embodiment of the present invention.
Figure 3:
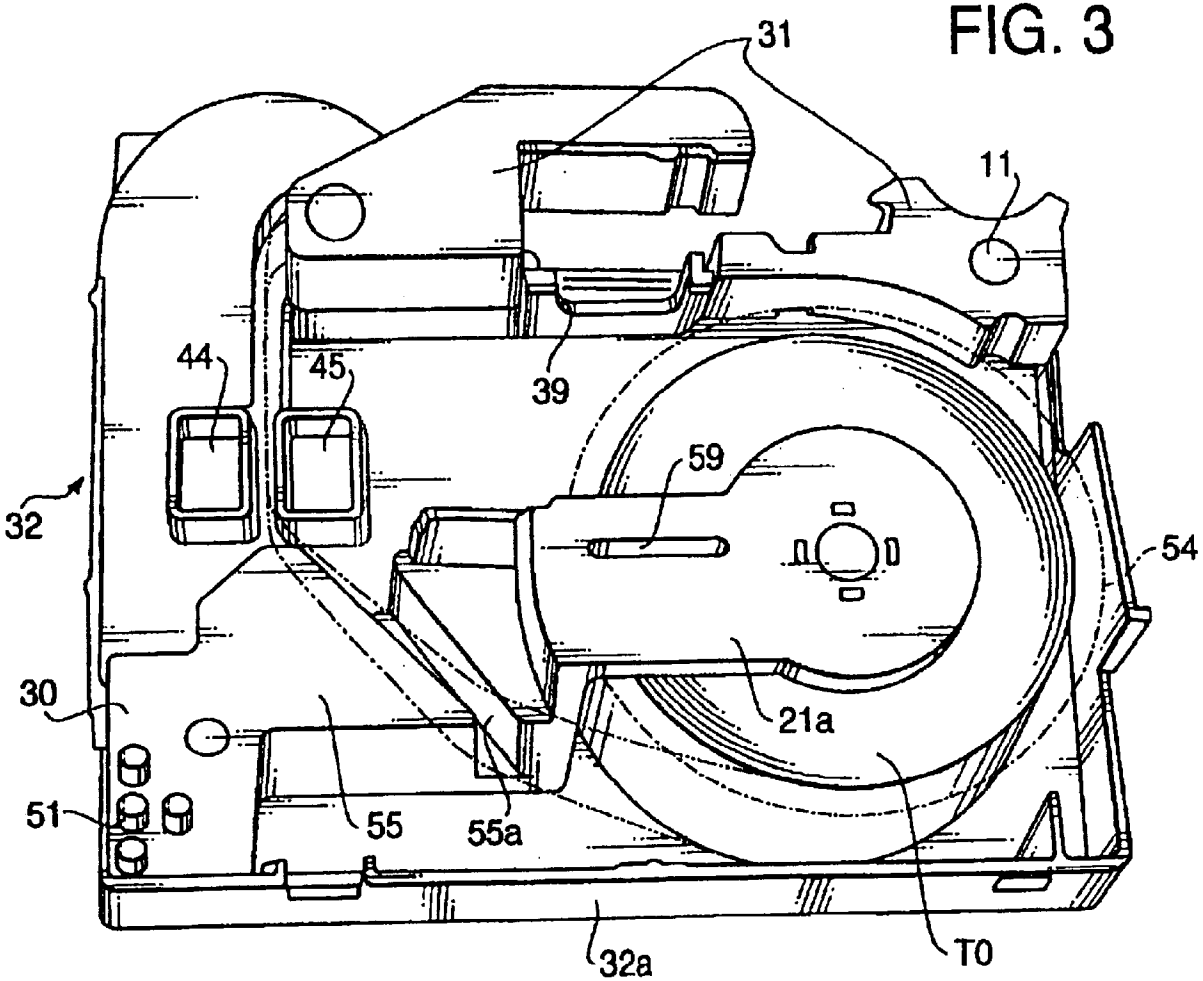
FIG. 3 is a perspective view of the tape cassette with its cassette cover removed and with a tape unit stored therein.

Referring now to the drawings, a description will be given in detail of preferred embodiments in accordance with the present invention. FIG. 1 is a plan view showing a tape printing device 1 with the cover 6 of its cassette storage section 8 closed. FIG. 2 is an exploded perspective view showing parts of a tape cassette. FIG. 3 is a perspective view showing a state in which a tape unit is set to a cassette case body.

Referring to FIG. 1, the upper surface of the body 1*a* of the tape printing device 1 is provided with: a keyboard section 2 having character input keys (for inputting characters such as letters for one or more lines and thereby generating a text which is composed of document data (code data)), a print key (for instructing the device to print the text), cursor keys (for moving a cursor horizontally and vertically on a liquid crystal display 3), control keys (for inputting instructions for starting new lines, executing processes, making selections, etc.); the liquid crystal display 3 for displaying characters (letters etc.) inputted from the keyboard section 2; and the cassette storage section 8 which stores a tape cassette 5 which will be explained later. The cover 6 for covering the cassette storage section 8 is supported at the rear end of the body 1*a* so that the cover can be opened and closed. As shown in FIG. 1, a tape cutter 7 for cutting a printed tape being ejected from an outlet 1*b* of the body 1*a* is placed at the left of the cassette storage section 8. An operation button 7*a* for the tape cutter 7 is placed at the rear end of the left side face of the body 1*a*.

In the cassette storage section 8, a ribbon roll-up spindle 10 and a tape feed roller spindle 9 are erected, which are driven and rotated by a tape feed motor (unshown) installed in the body 1*a* via proper driving mechanisms (unshown). Incidentally, while such a ribbon roll-up spindle is generally used for rolling up an ink ribbon in conventional tape cassettes (which are used for printing letters etc. on a film tape by use of the ink ribbon loaded therein), in the tape cassette 5 of this embodiment, the ribbon take-up spindle 10 does not take part in the print tape feeding operation since the tape cassette 5 does not include the ink ribbon nor its roll-up spool but employs a print tape T having a thermosensitive coloring property on which letters etc. can be printed without the use of an ink ribbon.

The tape feed roller spindle 9, placed obliquely in front of the ribbon roll-up spindle 10 (that is, placed near to the keyboard section 2), is erected so as to be fit in and engaged with a tape feed roller 11 of the tape cassette 5. In front of the cassette storage section 8, a thermal head 12 for carrying out the printing of characters (letters etc.) on the print tape T is installed. Further, a platen roller 13*a* and a tape feed auxiliary roller 13*b* for pressing the print tape T against the thermal head 12 and the tape feed roller 11 respectively are mounted on a roller holder (unshown) which is capable of moving toward and away from the tape cassette 5.

The rear part of the cassette storage section 8 (in the upper right-hand part of FIG. 1) is equipped with a tape type detection means (unshown) which includes unshown mechanical sensors (seven microswitches, for example) for detecting the type, width, etc. of the print tape T. The tape type detection means works in cooperation with tape detection parts 50*a* and 50*b* of the tape cassette 5 and a tape identification section 30 of a tape unit 20 which will be explained later, and thereby determines the width and type (color, transparent/semitransparent, colors of characters visible on the tape, material, etc.) of the print tape T stored in the tape cassette 5.

In the case where the tape type detection means is implemented by mechanical sensors, the type (tape width etc.) of the print tape T is detected based on the combination of ON/OFF signals which are outputted by the mechanical sensors each of which detects whether each blocking part 51 (to be explained later) makes contact therewith. Incidentally, instead of the mechanical sensors, magnetic sensors, photosensors, etc. can also be employed for the tape type detection section. As the photosensor, the well-known photocoupler (including a light-emitting element and a photoreceptor element as a pair) can be used.

The tape printing device 1 having the above composition is controlled by an electronic controller such as a microcomputer including a CPU, ROM, CGROM, RAM, buses, etc. The ROM stores various programs (print control program etc.) for the control of the tape printing device 1. The CPU carries out various operations based on programs stored in the ROM. In the ROM, outlined at a specifying the outline of each of a lot of characters (letters etc.) are also stored being classified into fonts (Gothic type, Ming-style type, etc.) and being associated with corresponding code data. Dot pattern data is spread out in an image buffer according to the outline data.

The CGROM stores the dot pattern data corresponding to each character inputted from the keyboard section 2. The dot pattern data corresponding to the inputted character is read out from the CGROM and a dot pattern is displayed on the liquid crystal display 3 based on the dot pattern data. The RAM is used for temporarily storing the results of various operations carried out by the CPU, in which some special-purpose memory units (text memory, image buffer, print buffer, etc.) are prepared.

The keyboard section 2, the aforementioned tape type detection section (for detecting the width of the print tape T), the liquid crystal display 3 and a display controller are connected to the aforementioned controller via input/output interfaces. When characters are inputted by use of the character input keys of the keyboard section 2, document data corresponding to the inputted characters are successively stored in the text memory, while dot patterns corresponding to the inputted characters are successively displayed on the liquid crystal display 3 according to a dot pattern generation program and a display control program. The thermal head 12, driven by an unshown driving circuit, performs the printing of the dot pattern data transferred from the image buffer to the print buffer. In sync with the tape printing operation by the thermal head 12, the tape feed motor driven by the driving circuit carries out feeding control for the print tape T.

In the following, the composition of the tape cassette 5, which is stored in the cassette storage section 8 of the tape printing device 1 composed as above, will be explained with reference to FIGS. 2 through 9. FIG. 2 is an exploded perspective view of the tape cassette 5, and FIG. 3 is a perspective view of the tape cassette 5 with its cassette cover 33 removed and with the tape unit 20 stored therein. The tape cassette 5 is basically composed of a cassette case body 32, the cassette cover 33 which is detachably attached to the cassette case body 32, and an auxiliary cover block 31 for covering parts in the cassette case body 32 (such as a tape feed section including a tape pull-out section 36, the tape feed roller 11, etc.) that are not covered by the cassette cover 33. Each component is formed of synthetic resin by means of injection molding.

The cassette case body 32 is made of a boxy case without its top, and its rear wall 32*a* is provided with a pair of latch holes 34 at both ends. With the latch holes 34, latches 35 protruding downward from the trailing edge of the cassette cover 33 (to be explained in detail later) are engaged.

The tape pull-out section 36, stretching to the left from the right-hand side of the front wall 32*b* of the cassette case body 32, is formed integral with the cassette case body 32, and a thermal head guide section 37 is formed integrally behind the tape pull-out section 36. The thermal head guide section 37 is formed in the shape of the letter "U" (as seen in a plan view), and the thermal head 12 is placed inside the U-shaped concavity 38. The rear wall of the U-shaped concavity 38 is provided with a latch slot 39, with which an elastic hook 40 (see FIGS. 2 and 4A) formed on the cassette cover 33 (which will be explained in detail later) will be engaged. The tape feed roller 11 (see FIGS. 1 and 4B), capable of engaging with the tape feed roller spindle 9 erected from the bottom of the cassette storage section 8 of the tape printing device 1, is placed between the thermal head guide section 37 and the left side wall of the cassette case body 32. Incidentally, the tape feed roller 11 and the auxiliary cover block 31 are not shown in FIG. 2 for clearly displaying the configuration of the front part of the cassette case body 32 including the latch slot 39.

In the left rear part of the cassette case body 32, a tape unit storage section 41 (see FIGS. 2 and 4B) is formed for accommodating and storing the tape unit 20. When the cassette cover 33 on the cassette case body 32 is closed, the tape unit storage section 41 has a suitable depth in which a roll part T0 (tape roll) of the tape unit 20 can securely be stored without tilting and rotatably.

Figure 4A:
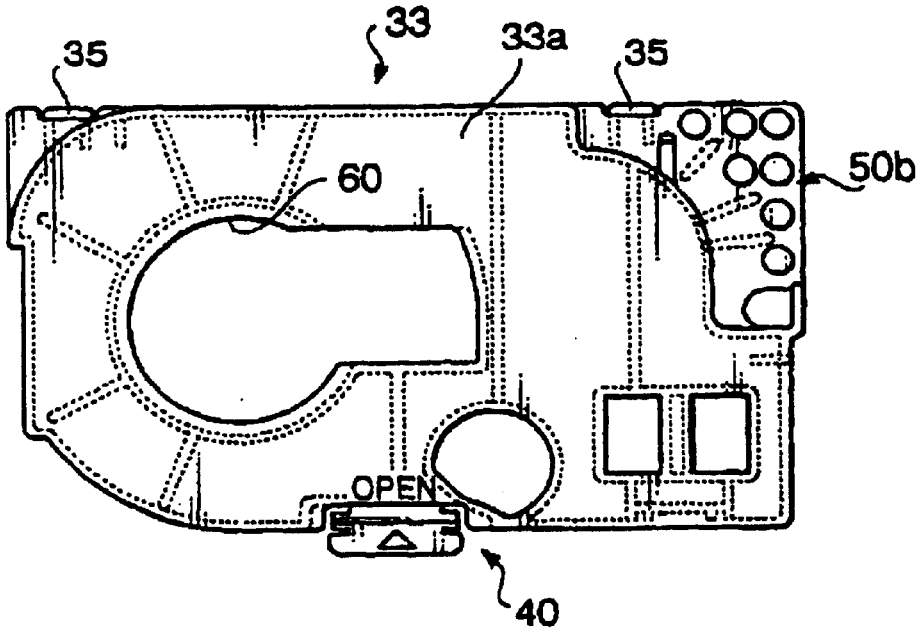
FIG. 4A is a plan view of the cassette cover.
Figure 4B:
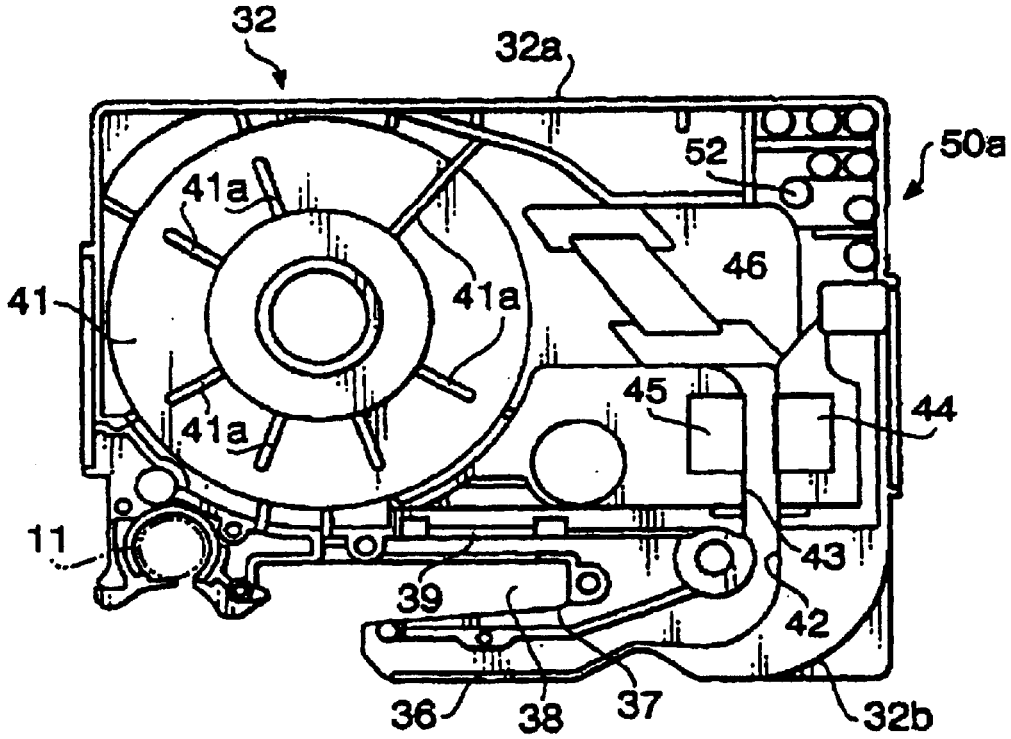
FIG. 4B is a plan view of a cassette case body of the tape cassette.
Figure 5A:
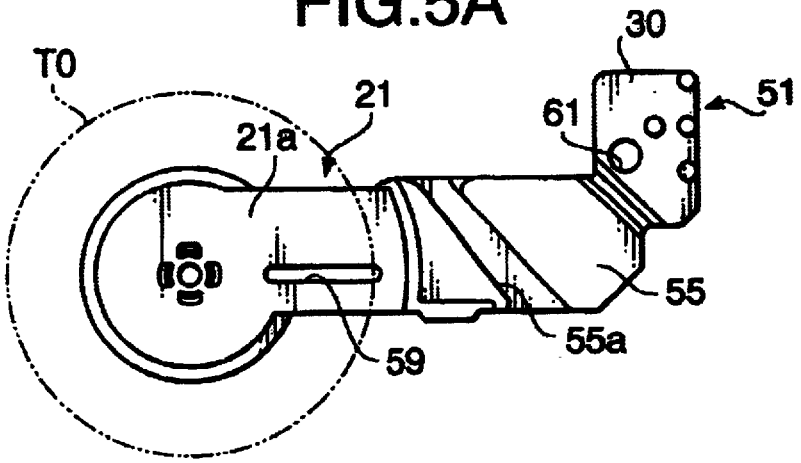
FIG. 5A is a plan view of the tape unit.
Figure 5B:
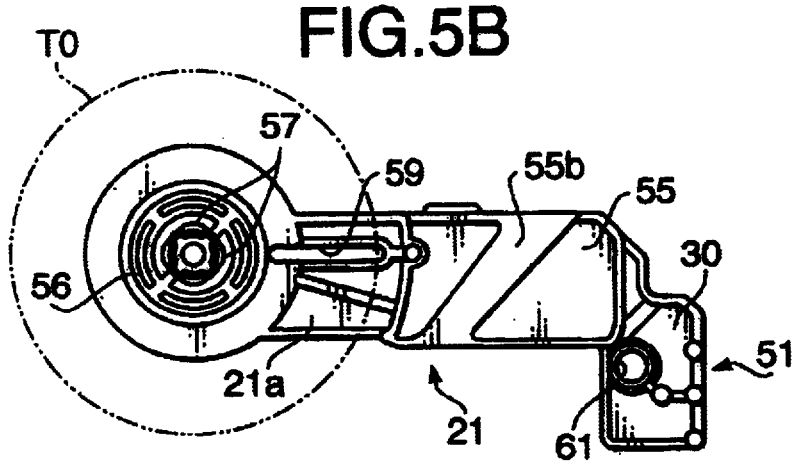
FIG. 5B is a bottom view of the tape unit.
Figure 6:
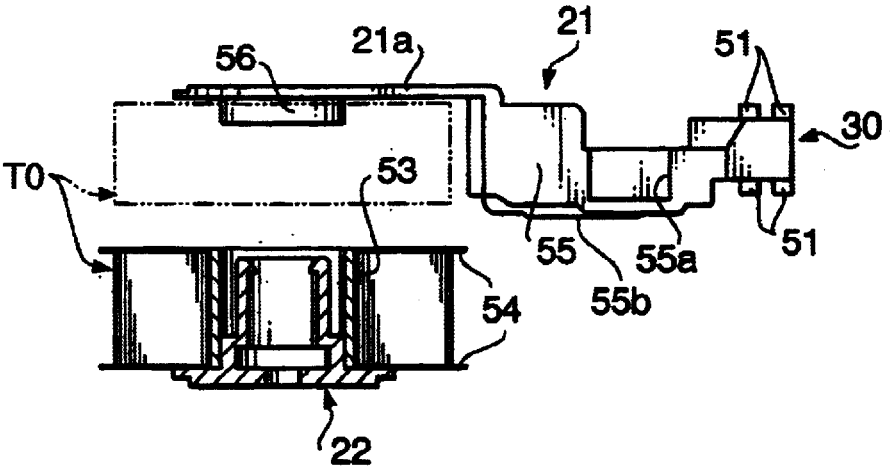
FIG. 6 is a side view showing the tape unit from which a lower spool has been removed.

In order to smoothly guide the print tape T (rolled up in the tape unit 20) to the thermal head guide section 37, tape guide walls 42 and 43 (in arcuate shapes as seen in a plan view) protrudes from the bottom of the cassette case body 32 (see FIGS. 2 and 4B). A pair of rectangular cavities 44 and 45 are formed on both sides of the tape guide walls 42 and 43, and an unshown photosensor (composed of a light-emitting device and a photoreceptor protruding from the cassette storage section 8) is fit in the rectangular cavities 44 and 45 so that the presence/absence of the print tape T passing through the tape guide walls 42 and 43 can be detected.

In right rear parts of the cassette case body 32 and the cassette cover 33, the tape detection parts 50*a* and 50*b* are formed, in which blocking parts 51 of the tape identification section 30 of the tape unit 20 are fit and set. For example, the tape detection part (50*a*, 50*b*) is composed of seven round holes, in which the blocking parts 51 protruding as round bars are selectively fit. By such composition, the detection of the width and type (color, transparent/semitransparent, possible colors of characters, material, etc.) of the print tape T becomes possible.

The depth of the tape unit storage section 41 when the cassette cover 33 on the cassette case body 32 is closed is determined variably depending on the width of the print tape T that is set to a corresponding tape unit 20. In this embodiment, six different tape widths (6 mm, 9 mm, 12 mm, 18 mm, 24 mm and 26 mm) are employed, therefore, tape cassettes 5 of six different heights (with the cassette cover 33 on the cassette case body 32 closed) are prepared. In the tape identification section 30 of each tape unit 20, a vertical through hole 61 as a tape width identification part is formed at a position that varies depending on the tape width. Meanwhile, in the tape detection part 50*a* on the cassette case body 32, a projection 52 (see FIGS. 2 and 4B) in the shape of around bar is formed upward at a prescribed position as a tape width detection part so that only proper tape units 20 corresponding to a preset tape width will be allowed to be set.

For example, the projection 52 of a tape cassette 5 corresponding to a tape width 12 mm is formed so that it will be fit in the registration hole 61 only when a proper tape unit 20 (to which a 12 mm-wide print tape T has been set) is attached to the tape cassette 5, rejecting improper tape units 20 (to which print tapes T of other tape widths have been set). The match/mismatch between the vertical through hole 61 as the tape width identification part and the projection 52 as the tape width detection part is determined and realized by a combination of the positions and the shapes of them. For example, even if a vertical through hole 61 and a projection 52 are equal in diameter, the tape unit 20 can not be attached to the tape cassette 5 if the positions of the parts differ from each other. Further, the attachment of the tape unit 20 becomes impossible if the projection 52 has a larger diameter than the vertical through hole 61 and can not be accommodated therein.

As shown in FIGS. 2, 3, 5A, 5B, etc., the tape unit 20 is composed of the print tape T rolled up around a spool tube 53, a support 21 which supports the upper edge of the print tape T, and a lower spool 22 which is inserted into the spool tube 53 from below for preventing the tape roll part T0 from slipping off. The support 21 made of synthetic resin includes a plate-like rotation support section 21*a* which extends outward to face and support the upper side surface of the roll part T0. The rotation support section 21*a* is formed to be slightly larger (in radius) than a spacer 54 (made of a resin film) whose radius is larger than the maximum radius of the roll part T0. From an end of the rotation support section 21*a*, a junction section 55 (curving toward the lower side of the print tape T in the tape width direction) and the tape identification section 30 extend integrally.

The junction section 55 is provided with a guide groove 55*a* having a cross-sectional shape like "U" (see FIGS. 2 and 3) so that the lower edge of the print tape T pulled out from the roll part T0 can be guided toward the pair of tape guide walls 42 and 43.

In the cassette case body 32, the bottom of the tape unit storage section 41 is provided with seven ribs 41*a* protruding therefrom in a radial pattern. When the tape unit 20 is stored in the tape unit storage section 41, the roll part T0 of the print tape T is put on the ribs 41*a*. A part of the junction section 55 where the guide groove 55*a* is formed is thinned down in order to eliminate the level difference between the bottom of the guide groove 55*a* and the top of the ribs 41*a* and to let the print tape T pulled out from the roll part T0 run smoothly without vibrating in the tape width direction. In order to thicken and reinforce the thinned part of the junction section 55, a projecting part 55*b* projecting downward is provided to the underside of the thinned part.

At a part of the tape unit storage section 41 that faces the projecting part 55*b* when the tape unit 20 is stored in the tape unit storage section 41, an opening 46 capable of receiving the projecting part 55*b* is formed. When the projecting part 55*b* is inserted in the opening 46, the bottom of the guide groove 55*a* becomes substantially on the same level as the top of the ribs 41*a* of the tape unit storage section 41, by which the print tape T pulled out from the roll part T0 is allowed to run smoothly toward the guide groove 55*a* without vibrating in the tape width direction. In this state, the under surface of the projecting part 55*b* forms a single surface together with the under surface of the cassette case body 32, without protruding therefrom.

Figure 7:
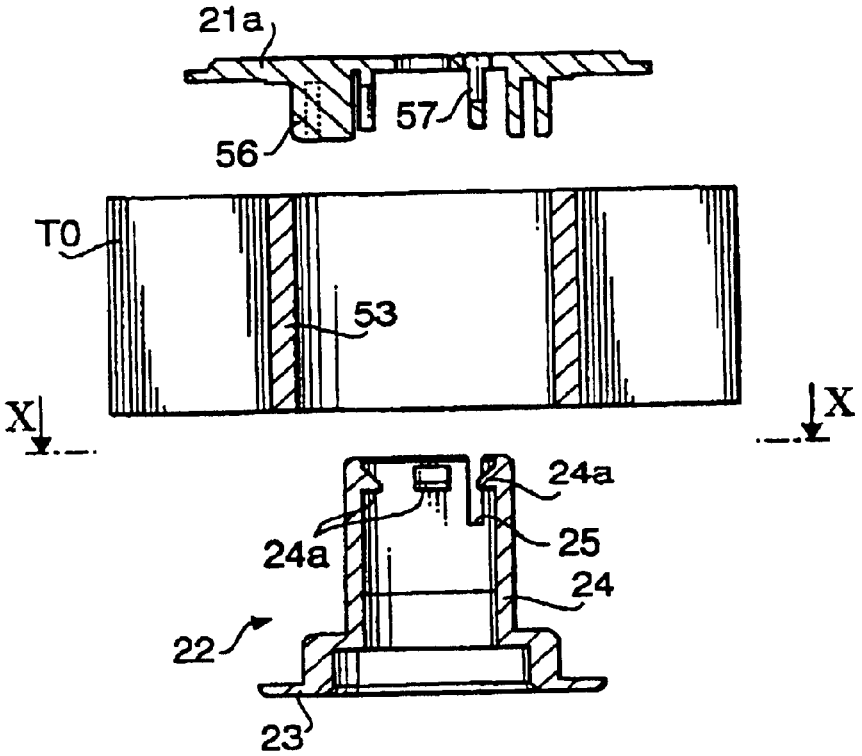
FIG. 7 is a cross-sectional view showing a rotation support section of the tape unit, a roll part of a tape, and the lower spool.
Figure 8:
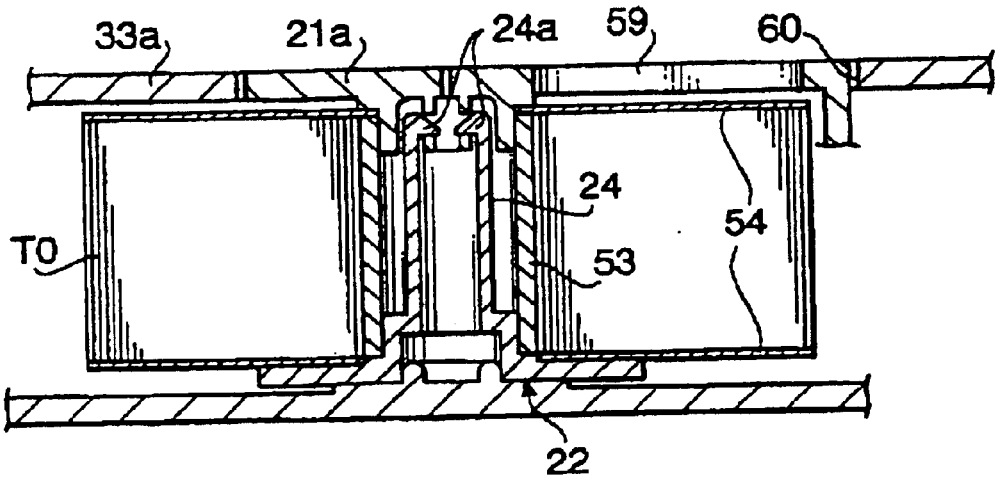
FIG. 8 is cross-sectional view showing the tape unit which is covered by the cassette cover, taken along the line VIII—VIII shown in FIG. 2.
Figure 9:
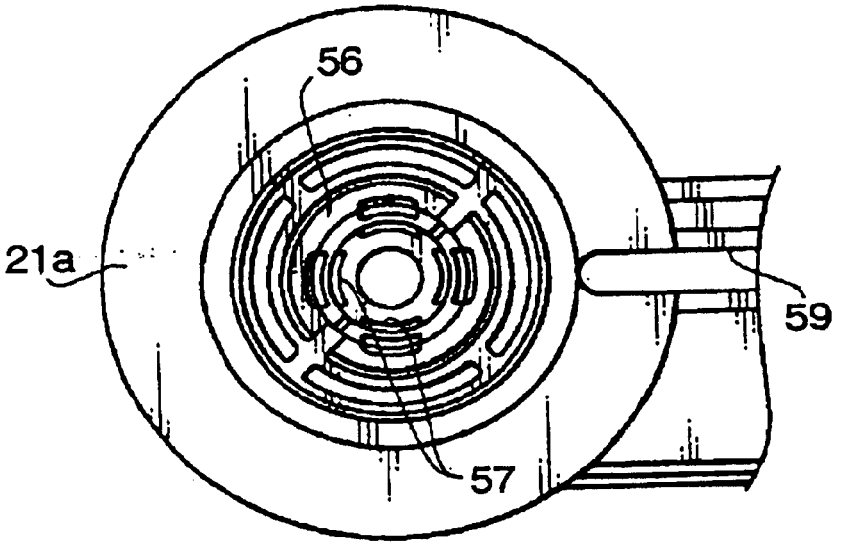
FIG. 9 is a bottom view of the rotation support section.
Figure 10:
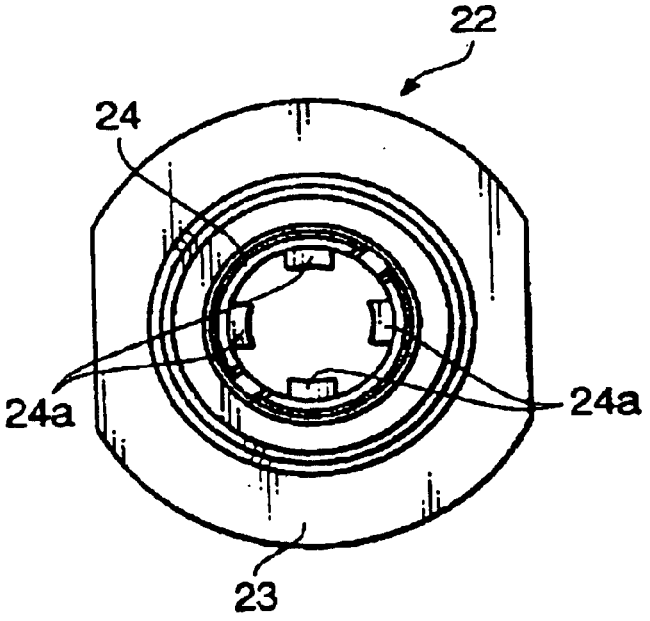
FIG. 10 is a plan view of the lower spool seen in the direction of the arrows X shown in FIG. 7.

On the under surface of the rotation support section 21*a*, a convex part 56, capable of fitting in the inner surface of the spool tube 53, is formed to protrude downward, and the rim of the convex part 56 is provided with a plurality of (four in this embodiment) latch holes 57 with which a plurality of (four in this embodiment) latches 24*a* of the lower spool 22 (to be described later) can be engaged (see FIGS. 7, 8 and 9). Meanwhile, in the lower spool 22 (see FIGS. 7, 8 and 10), the latches 24*a* are inwardly formed on the inner surface of a tube part 24 which protrudes upward from a flange part 23 of the lower spool 22. By inserting the tube part 24 into the spool tube 53 of the roll part T0 and letting the latches 24*a* engage with the latch holes 57, the lower spool 22 is firmly attached to the rotation support section 21*a* of the support 21, by which the roll part T0 is supported by the tube part 24 rotatably and undetachably. At the upper end of the tube part 24, a plurality of open grooves 25 are formed upwardly, by which the upper end of the tube part 24 narrows elastically when the latches 24*a* are engaged with the latch holes 57.

In the support 21 of the tape unit 20, the plate-like rotation support section 21*a* is provided with an observation window 59 which extends in the radial direction of the roll part T0. In this embodiment, the observation window 59 stretches inward almost to the rim of the convex part 56 so that the print tape T rolled up around the spool tube 53 can be seen up to its inner end, while stretching toward the junction section 55 so that the print tape T can be seen even when the roll part T0 has its maximum radius (when the print tape T has not been used yet).

An upper plate 33*a* of the cassette cover 33 is provided with a supporting section 60 by which the plate-like rotation support section 21*a* can be accommodated and supported firmly and through which the whole observation window 59 can be seen. In this embodiment, the rotation support section 21*a* is formed in a noncircular shape, and the supporting section 60 is formed as an opening in which part or all of the rotation support section 21*a* is fit firmly. As another example of the supporting section 60, it is possible to let part of the rotation support section 21*a* protrude upward and to provide the upper plate 33*a* of the cassette cover 33 with a supporting section 60 having an upward concavity for receiving the protrusion, forming the supporting section 60 by means of two-tone molding using a transparent material. It is also possible to provide the rotation support section 21*a* and the under surface of the upper plate 33*a* with one or more openings (unshown) and projections (for engaging with the openings) respectively while giving the upper plate 33*a* a window or opening (unshown) having the same shape and horizontal position as the observation window 59 of the rotation support section 21*a*. In either case, it is important that the whole observation window 59 can be seen from outside the cassette cover 33.

By the above composition, when the tape cassette 5 is stored in the cassette storage section 8 of the tape printing device 1, the bar-like blocking parts 51 protruding downward from the under surface of the tape identification section 30 of the support 21 are detected by the tape type detection means. The width, type, etc. of the print tape T attached to the tape unit 20 can be detected based on on/off signals outputted by the tape type detection means which detects the number and positions of the blocking parts 51.

By providing the upper surface of the tape identification section 30 with the same number of blocking parts 51 at the same positions and letting them fit in the tape detection part 50*b* of the cassette cover 33, the support 21 of the tape unit 20 can be prevented from tilting, getting out of place, etc. Further, as mentioned before, the tape identification section 30 is provided with the vertical through hole 61 as the tape width identification part varying its position and shape (size) depending on the tape width, and the tape detection part(s) 50*a* and/or 50*b* of the cassette case body 32 and/or the cassette cover 33 is provided with the projection 52 (as the tape width detection part) to be paired with the vertical through hole 61 (as the tape width identification part) so that only a tape unit 20 having the print tape T of a proper tape width can be set. Therefore, attaching a tape unit 20 for a narrow tape to a tape cassette 5 for a wide tape can be prevented, by which tilting and vertical motion of the tape unit 20 in the tape cassette 5 can be avoided and tape troubles (skewing, snagging, etc. of the print tape T being pulled out from the roll part T0) can be eliminated.

Incidentally, the sectional form of the vertical through hole 61 as the tape width identification part and the projection 52 to be fit in the vertical through hole 61 is not limited to the circle but ellipsoid, rectangle, polygon, etc. can also be employed. It is also possible to provide a convexity or projection to the tape width identification part instead of the vertical through hole 61, and a concavity or hole to the tape width detection part of the tape cassette 5 instead of the projection 52.

When the tape cassette 5 composed as above is loaded in the cassette storage section 8 of the tape printing device 1, in the case where the cassette storage section 8 is formed to open upward as shown in FIG. 1, the thermal head 12 protruding upward from the bottom of the cassette storage section 8 is positioned in the U-shaped concavity 38 of the thermal head guide section 37. On the other hand, although not shown, in cases where the cassette storage section 8 is designed to open downward (on the underside of the tape printing device 1), the tape cassette 5 may be stored in the cassette storage section 8 with the cassette cover 33 facing upward and the base of the cassette case body 32 may be covered by an unshown cover in order to avoid dropping. In this case, it is preferable that the tape detection part 50*b* on the cassette cover 33 be placed to face the tape type detection means of the cassette storage section 8 of the tape printing device 1.

In either case, the thermal head 12 is placed inside the tape cassette 5 and a plurality of heating elements of the thermal head 12 are positioned to face and contact a thermosensitive coloring layer of the print tape T (since the tape is rolled up around the spool tube 53 with the thermosensitive coloring layer facing inward as mentioned before).

When the tape printing device 1 is in operation, the platen roller 13*a* and the tape feed auxiliary roller 13*b* are positioned to face and press the thermal head 12 and the tape feed roller 11 respectively, by which the print tape T of the tape unit 20 stored in the tape unit storage section 41 of the cassette case body 32 is pulled out by the cooperation of the tape feed roller 11 and the tape feed auxiliary roller 13*b* and is smoothly guided to the tape pull-out section 36 through the tape guide walls 42 and 43, while characters (letters etc.) are printed on the thermosensitive coloring layer of the print tape T by the cooperation of the thermal head 12 and the platen roller 13*a* at the U-shaped concavity 38 of the thermal head guide section 37. Thereafter, the lettered print tape T (with the characters printed thereon) is ejected from the tape printing device 1 through the outlet 1*b* by the cooperation of the tape feed roller 11 and the tape feed auxiliary roller 13*b*.

Whether or not the print tape T rolled around the spool tube 53 is running short/out by the creation of the lettered tapes (by the printing of characters on the thermosensitive coloring layer of the print tape T as described above) can be judged easily by observing the radius of the roll part T0 through the observation window 59 from above the cassette cover 33. When the print tape T ran out, the used tape unit 20 is replaced with a new tape unit 20 having a brand-new roll part T0 of the print tape T. For the replacement, the tape cassette 5 is took out of the cassette storage section 8 first. Subsequently, the engagement of the elastic hook 40 of the cassette cover 33 with the latch slot 39 of the cassette case body 32 is released by pressing a knob of the elastic hook 40, and the cassette cover 33 is removed from the cassette case body 32. Thereafter, the support 21 with the empty roll part T0 is removed from the tape unit storage section 41 together with the lower spool 22, and a new replacement tape unit 20 (having a brand-new roll part T0 of the print tape T) is stored in the tape unit storage section 41.

Since the top of the cassette case body 32 has become open (with the cassette cover 33 removed), the user holds the print tape T by its upper edge (upper in the tape width direction), pulls the print tape T out of the roll part T0, feeds the print tape T to the tape pull-out section 36 via the guide groove 55*a* of the tape unit 20 and the tape guide walls 42 and 43, and places the end of the print tape T at a position facing the tape feed roller 11.

At this stage, the spool tube 53 and the roll part T0 of the print tape T have been set and supported by the support 21 and the lower spool 22 rotatably and undetachably as one piece, and the tape identification section 30 has been integrally provided to the support 21. Therefore, by returning the tape cassette 5 to the original position (in the cassette storage section 8 of the tape printing device 1) after replacing the tape unit 20 and feeding the end of the print tape T to the aforementioned position facing the tape feed roller 11, the tape printing device 1 is automatically enabled to carry out the judgment on the tape type etc.

As described above in detail, in the tape cassette 5 according to the above embodiment, the cassette case body 32 and the cassette cover 33 can be reused when the tape unit 20 is replaced, by which running costs of the tape printing device 1 can be reduced.

Incidentally, the print tape T employed in the above embodiment is composed of a base tape, the thermosensitive coloring layer formed on one surface of the base tape, and strippable paper which is stuck on the other surface of the base tape via an adhesive layer. Discoloration of the thermosensitive coloring layer can be prevented since the print tape T is rolled around the spool tube 53 with the thermosensitive coloring layer facing inward. For the roll part T0, the aforementioned spacer 54 formed of PET (polyethylene terephthalate) films and the like are used for preventing the adhesive from oozing out of both edge faces of the roll part T0 (at both ends of the print tape T in the tape width direction) and sticking to the under surface of the rotation support section 21*a* of the support 21 and the upper surface of the flange part 23 of the lower spool 22, by which smooth rotation of the roll part T0 is ensured when the print tape T is pulled out.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

For example, while the cassette cover 33 was employed in the above embodiment, the tape cassette 5 can also be composed of the cassette case body 32 and the tape unit 20 only, without the cassette cover 33. It is also possible to form the rotation support section 21*a* of the tape unit 20 integrally with the cassette cover 33 in one piece.

While the cassette cover 33 was provided to be separable from the cassette case body 32 in the above embodiment, the cassette cover 33 can also be linked with the cassette case body 32 by use of the well-known hinge mechanism etc., letting the cassette cover 33 be openable/closable but undetachable from the cassette case body 32.

INDUSTRIAL APPLICABILITY

As set forth hereinabove, according to the present invention, in a tape cassette to be used for a tape printing device, comprising: a cassette case body; its cassette cover; and a tape unit including a rolled print tape which is detachably stored between the cassette case body and the cassette cover, the tape unit is provided with a tape identification section for identifying the type etc. of the rolled tape. In the tape identification section, a tape width identification part is provided varying its position or shape depending on the width of the tape. Meanwhile, the cassette case body and/or the cassette cover is provided with a tape detection part to which the tape identification section can be set or attached, while being provided with a tape width detection part to be paired with the tape width identification part so that only a tape unit including a rolled print tape having a preset tape width is allowed to be attached to the tape cassette.

Therefore, in a tape cassette exchangeably storing a tape unit, the identification of the width and type of the print tape becomes possible when the tape unit is replaced, by which erroneous loading of an improper tape unit (to which a print tape of a different tape width has been set) in the tape cassette can be prevented. By this, even when the user tried to attach a tape unit for a narrow print tape to a tape cassette capable of storing a tape unit for a wide print tape, the erroneous attachment is prevented, by which troubles in printing caused by the erroneous attachment of the tape unit can be eliminated.

What is claimed is:

1. A tape cassette which is attached to a tape printing device having a printing section and used therein, comprising a body for storing a tape unit including a rolled print tape, wherein:

said tape cassette detachably stores said tape unit having a first identification part for identifying a width of said rolled print tape and a second identification part for identifying a type of said rolled print tape, said tape cassette includes a tape width detection member which detects said first identification part, said first identification part and said tape width detection member being formed such that only tape units that include said rolled print tape having a preset tape width will be allowed to be stored in said tape cassette, said first identification part is configured to prevent said tape unit from being stored in said tape cassette if said tape unit accommodates said rolled print tape whose width does not correspond to the preset tape width that is usable in the tape cassette, and said second identification part is detected by a tape type detection member of the tape printing device and thereby the type of said rolled print tape of said tape unit is detected.

2. The tape cassette according to claim 1, wherein:

said first identification part is provided such that a position of said first identification part is varied depending on the width of said rolled print tape, and said tape width detection member detects the width of said tape depending on the position of said first identification part.

3. The tape cassette according to claim 1, wherein:

said tape width detection member includes an engaging part, and said first identification part includes an engaged part to be engaged with said engaging part.

4. The tape cassette according to claim 3, wherein:

said engaging part includes an engaging projection, and said engaged part includes an engaging hole to be engaged with said engaging projection.

5. The tape cassette according to claim 1, wherein:

said tape unit includes a rotation support section for firmly holding a spool which fits in a roll part of said print tape, and said first identification part and said second identification part are formed to extend from said rotation support section.

6. The tape cassette according to claim 1, wherein:

a body of said tape cassette includes a cassette cover and a cassette case body for detachably storing said tape unit, and said tape width detection member is formed on said cassette case body.

7. The tape cassette according to claim 1, wherein:

a body of said tape cassette includes a cassette cover and a cassette case body for detachably storing said tape unit, and said tape width detection member is formed on at least one of said cassette cover and said cassette case body.

8. A tape unit comprising a rolled print tape having a preset width, for being stored in a tape cassette having a preset height, the tape cassette being attached to a tape printing device having a printing section and being used therein, wherein:

said tape unit includes a first identification part for identifying the width of said rolled print tape and a second identification part for identifying a type of said rolled print tape, said first identification part is detected by a tape width detection member of the tape cassette so that said tape unit will be able to be stored in the tape cassette having the preset height, said first identification part is configured to prevent said tape unit from being stored in said tape cassette if said tape unit accommodates said rolled print tape whose preset width does not correspond to a preset tape width that is usable in the tape cassette, and said second identification part is detected by a tape type detection member of the tape printing device so that the type of said rolled print tape of said tape unit will be judged.

9. The tape unit according to claim 8, wherein:

said first identification part is provided such that a position of said first identification part is varied depending on the width of said rolled print tape, and said tape width detection member detects the width of said tape depending on the position of said first identification part.

10. The tape unit according to claim 9, wherein:

said tape width detection member includes an engaging part, and said first identification part includes an engaged part to be engaged with said engaging part.

11. The tape unit according to claim 10, wherein:

said engaging part includes an engaging projection, and said engaged part includes an engaging hole to be engaged with said engaging projection.

12. The tape unit according to claim 8, wherein:

said tape unit includes a rotation support section for firmly holding a spool which fits in a roll part of said rolled print tape, and said first identification part and said second identification part are formed to extend from said rotation support section.

13. A tape cassette which is attached to a tape printing device having a printing section and used therein, comprising a body for storing a tape unit including a rolled print tape, wherein:

said tape cassette detachably stores said tape unit having a first identification part for identifying a the width of said rolled print tape and a second identification part for identifying a type of said rolled print tape, said tape cassette includes a tape width detection member which works in cooperation with said first identification part, said first identification part and said tape width detection member being formed such that only units that include said rolled print tape having a preset tape width will be allowed to be stored in said tape cassette, said first identification part is configured to prevent said tape unit from being stored in said tape cassette if said tape unit accommodates said rolled print tape whose width does not correspond to the preset tape width that is usable in the tape cassette, and said second identification part is detected by a tape type detection member of the tape printing device and thereby the type of said rolled print tape of said tape unit is detected.

14. The tape cassette according to claim 13, wherein:

said tape width detection member includes an engaging part, and said first identification part includes an engaged part to be engaged with said engaging part.

15. The tape cassette according to claim 14, wherein:

said engaging part includes an engaging projection, and said engaged part includes an engaging hole to be engaged with said engaging projection.

16. The tape cassette according to claim 15, wherein:

said engaged part is provided such that a position of said engaged part is varied depending on the width of said rolled print tape, and said engaging part forms a cooperative state with said engaged part that varies depending on the position of said engaged part.

17. A tape unit comprising a rolled print tape having a preset width, for being stored in a tape cassette having a preset height, the tape cassette being attached to a tape printing device having a printing section and being used therein, wherein:

said tape unit includes a first identification part for identifying the width of said rolled print tape and a second identification part for identifying a type of said rolled print tape, and said first identification part works in cooperation with a tape width detection member of the tape cassette so that said tape unit will be able to be stored in the tape cassette having the preset height, said first identification part is configured to prevent said tape unit from being stored in said tape cassette if said tape unit accommodates said rolled print tape whose preset width does not correspond to a preset tape width that is usable in the tape cassette, and said second identification part is detected by a tape type detection member of the tape printing device so that the type of said rolled print tape of said tape unit will be judged.

18. The tape unit according to claim 17, wherein:

said tape width detection member includes an engaging part, and said first identification part includes an engaged part to be engaged with said engaging part.

19. The tape unit according to claim 18, wherein:

said engaging part includes an engaging projection, and said engaged part includes an engaging hole to be engaged with said engaging projection.

20. The tape unit according to claim 19, wherein:

said engaging hole is provided such that a position of said engaging hole is varied depending on the width of said rolled print tape, and said engaging projection forms a cooperative state with said engaging hole that varies depending on the position of said engaging hole.

* * * * *